US006591733B1

(12) United States Patent
Engström

(10) Patent No.: US 6,591,733 B1
(45) Date of Patent: Jul. 15, 2003

(54) LOADING SYSTEM

(75) Inventor: Sven-Erik Engström, Karlskoga (SE)

(73) Assignee: Bofors Defence AB, Karlskoga (SE)

( * ) Notice: Subject to any disclaimer, the term of this patent is extended or adjusted under 35 U.S.C. 154(b) by 0 days.

(21) Appl. No.: 09/889,690

(22) PCT Filed: Nov. 15, 1999

(86) PCT No.: PCT/SE99/02078

§ 371 (c)(1),
(2), (4) Date: Oct. 16, 2001

(87) PCT Pub. No.: WO00/43723

PCT Pub. Date: Jul. 27, 2000

(30) Foreign Application Priority Data

Jan. 20, 1999 (SE) ..... 9900152

(51) Int. Cl.[7] ..... F41A 9/00
(52) U.S. Cl. ..... 89/45; 89/46; 89/47; 89/33.05
(58) Field of Search ..... 89/45–47, 33.04, 89/33.1, 36.08, 1.41, 33.05

(56) References Cited

U.S. PATENT DOCUMENTS

| | | | | | |
|---|---|---|---|---|---|
| 2,851,928 | A | * | 9/1958 | Hultgren et al. | 89/45 |
| 3,106,866 | A | * | 10/1963 | Klapdohr et al. | 89/45 |
| 3,242,813 | A | * | 3/1966 | Carlsson | 89/46 |
| 3,242,814 | A | * | 3/1966 | Carlsson | 89/46 |
| 3,855,899 | A | * | 12/1974 | Billottet et al. | 89/1.41 |
| 4,038,906 | A | | 8/1977 | Tidstrom | 89/46 |
| 4,727,790 | A | * | 3/1988 | DeHaven et al. | 89/46 |
| 4,763,559 | A | * | 8/1988 | Bouillon | 89/33.04 |
| 4,957,028 | A | | 9/1990 | Lieberum et al. | 89/47 |
| 5,131,316 | A | * | 7/1992 | Lawrence et al. | 89/46 |
| 5,311,807 | A | * | 5/1994 | Ruttgerodt | 89/36.08 |
| 5,333,530 | A | * | 8/1994 | Simon et al. | 89/47 |
| 5,604,327 | A | * | 2/1997 | Skoglund et al. | 89/46 |
| 5,728,966 | A | * | 3/1998 | Bobinger et al. | 89/46 |
| 5,811,721 | A | * | 9/1998 | Andersson et al. | 89/33.01 |
| 5,831,201 | A | * | 11/1998 | Andersson et al. | 89/45 |
| 5,844,163 | A | | 12/1998 | Lindskog | 89/46 |
| 6,095,026 | A | * | 8/2000 | Poussard et al. | 89/46 |
| 6,443,045 | B1 | * | 9/2002 | Kohltsedt et al. | 89/45 |

FOREIGN PATENT DOCUMENTS

| | | | | |
|---|---|---|---|---|
| DE | 42 05 963 A1 | | 9/1993 | |
| DE | 43 24 572 A1 | | 1/1995 | |
| EP | 522831 A2 | * | 1/1993 | 89/45 |
| FR | 2704943 | * | 7/1984 | 89/45 |
| JP | 05174394 | * | 6/1994 | 89/45 |
| WO | WO 96/21133 | | 7/1996 | |

* cited by examiner

*Primary Examiner*—Michael J. Carone
*Assistant Examiner*—L. Semunegus
(74) *Attorney, Agent, or Firm*—Connolly Bove Lodge & Hutz LLP

(57) ABSTRACT

The present invention relates to a method and a device for handling artillery shells (14–16) when loading artillery guns (1) that have an integral shell magazine (9) fixed in the traverse system but independent from the elevating mass, which magazine on command feeds out shells (14–16) one by one with a specific linear velocity in the longitudinal axis of each shell. Each shell is subsequently transferred to the loading position for the gun by a loading pendulum (13) and cradle (6). The basic idea behind the present invention is that the outfeed velocity of the shells (14–16) from the magazine (9) shall be braked to zero in a brake module (12) mounted on the gun while they lie in a shell carrier (17, 18) mounted on the loading pendulum (13). Immediately after the linear velocity of the shell has been braked to zero and its rear plane has been reversed to a pre-defined position the shell carrier (17, 18) takes over the handling of the shell and re-angles it to coincide with the angle of elevation of the gun, and transfers the shell to a laterally displaceable shell loading cradle (6).

22 Claims, 7 Drawing Sheets

LOADING SYSTEM

Figure 1:
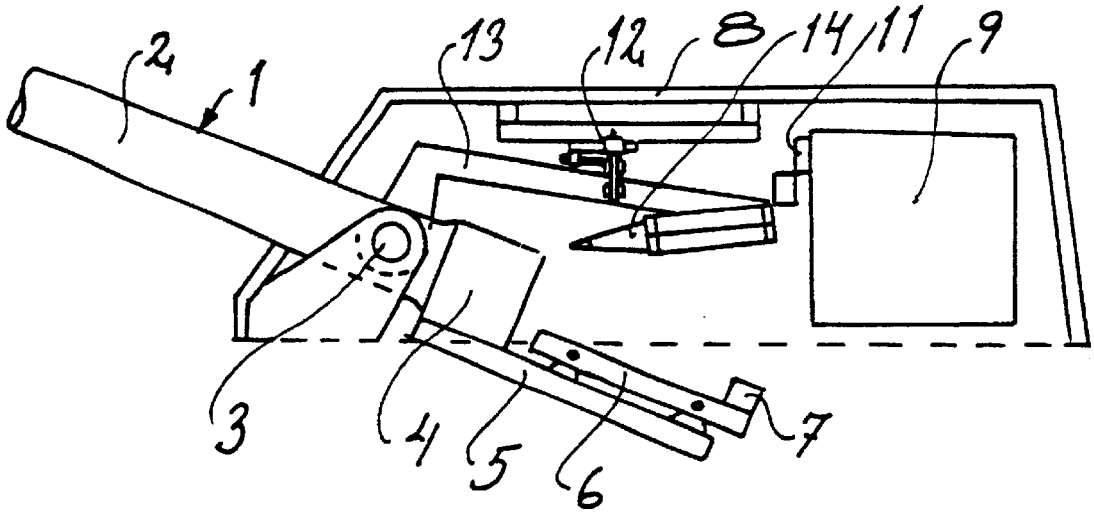

The present invention relates to a method and a device for handling artillery shells when loading artillery guns that have an integral shell magazine fixed in the traverse system but independent from the elevating mass, which magazine on command feeds out shells one by one with a specific linear velocity in the longitudinal axis of each shell. Each shell is subsequently transferred to the loading position for the gun by a loading pendulum and cradle.

The logical location for a magazine incorporated in the gun and fixed in the traverse system but independent from the elevating mass is directly beside the gun as the magazine must not obstruct the recoil of the gun. This in turn means that transfer of shells from the magazine to alignment with the breech opening must involve both a lateral transfer to alignment with the direction of the barrel and adjustment of the angle to coincide with the angle of elevation of the gun.

The present invention is primarily intended for heavy and medium artillery guns that are equipped with a fully automatic loading system.

On the eve of the 21$^{st}$ century one must count on the fact that each artillery gun will necessarily be self-propelled and constitute its own artillery system, thus incorporating its own fire control and a sufficient number of rounds for at least a limited number of engagements. The capabilities that already exist for locating artillery guns that give fire and then rapidly deploying counter-fire will result in a requirement for an absolute minimum limit on the time that an artillery gun can be permitted to give fire, after which the artillery gun must leave the deployment sites rapidly as possible.

The need to fire the maximum number of rounds in the shortest possible time more or less assumes that the guns are equipped with fully automatic loading systems. Such fully automatic loading systems must be able to handle a number of different types of shells and propellant charges which, moreover, may often be fired directly after each other in one and the same artillery salvo. This means in turn that both shells and propellant charges must be handled at the greatest possible speed inside their respective magazines, as well as between the magazines and the loading pendulums and cradles normally used to transfer shells and propellant charges between each magazine and the breech opening.

By reason of their relatively high dead weight shells especially may give rise to a number of handling problems resulting from the combination of their dead weight and the high handling velocities that may be upwards of several metres per second.

The gun system in the present invention assumes that the shell magazine is incorporated in the traverse system but is not part of the elevating mass. To enable the gun to maintain a high rate of fire it is necessary for the shells to be fed out from the shell magazine at high speed and then to have this outfeed velocity braked to zero immediately thereafter, then—at the same high speed—be re-positioned to the same angle of elevation as the gun and be rammed.

Ramming the shells into the gun necessitates a loading cradle and rammer. It must also be possible for the cradle to be moved to the side so as not to obstruct gun recoil. In addition to the transfer movements of the shell already mentioned, the shell needs to be moved laterally while located in the cradle.

Even if a lateral transfer movement and ramming of the shells are assumed to be achieved using a separate loading cradle, a loading pendulum that can both brake and re-align the shells will necessarily be heavy and unwieldy.

As claimed in the present invention it is proposed that these two functions be divided between two closely interacting but mechanically independent devices of which the first—the brake module—is designed to receive the shell and brake its outfeed motion within a short linear distance and provide a pre-defined stop position for the rear plane of the shell, after which the brake device of the brake module is deactivated and the shell is taken over by the shell loading pendulum that re-aligns it with the angle of the rammer that shall coincide with the angle of elevation of the gun and the shell shall be transferred to the rammer. Retardation of the shell is thus achieved during a short forwards motion, after which the shell is returned rearwards a short distance to a pre-defined stop position. By using a pre-defined stop position for the rear plane of the shell as the initial point for transfer of the shell to the loading pendulum we have devised a device that can handle shells of various lengths designed for the same artillery gun. We must, namely, assume that in the future there will be shells available in different lengths designed for different purposes and ranges.

On a practical level it is proposed that the device as claimed in the present invention be designed with a first brake device mounted in the brake module that grips the front section of the shell and that is linked to a linearly operating short-stroke brake and return function. The brake device is thus designed with a grab jaws device openable in one direction, preferably downwards, that is suitably equipped with brake blocks for engagement with the front conical nose section of the shell.

As the brake device grips the shell ahead of the centre of the shell, the centre and rear sections of the shell are available for engagement with the shell carrier incorporated in the loading pendulum. As claimed in one development of the present invention this shell carrier is designed so that initially it constitutes a guide chute for the shells from the outfeed aperture of the magazine to the brake blocks of the brake device. The shell can also be returned in the guide chute to rest against a deployable rear stop lug that shall constitute the pre-defined rear stop position. As soon as the shell has reached this stop position the brake device can be deactivated/opened after which the shell loading pendulum-which is arranged in parallel with the linear direction of motion of the brake device and that is pivotable around the trunnion centre of the gun—can be pivoted downwards towards the loading pendulum without the brake device obstructing the shell carried in the shell carrier. Simultaneous with this movement the shell carrier is re-angled relative to the loading pendulum carrier arm so that when the shell reaches the rammer the shell has a horizontal angle position that is parallel to the shell loading cradle. The re-angling of the actual loading pendulum can be achieved using a chain-drive driven by an electric motor, while the re-angling between the loading pendulum carrier arm and the shell carrier can, for example, be controlled by a slewing bracket system between the loading pendulum and the shell carrier in which the slewing bracket system is controlled by a fixed arc mounted on the gun that always gives the shell carrier the correct angle depending on the angular position of the shell loading pendulum.

Provided the shell in the shell carrier is at an angle so that at least part of its own weight rests against the previously mentioned deployable stop lug throughout the re-angling of the shell carrier until it reaches the shell loading cradle, no special securing device will be needed for the shell as its own weight will ensure that it lies still in the shell carrier during re-angling.

As claimed in the above indicated functional sequence the shell carrier must, in the first instance, act as a guide chute leading to the brake blocks of the brake device for the shells fed out from the magazine at high velocity by a force imparted from the rear and, secondly, must secure each shell during re-angling—achieved by its own rearwards acting weight against the stop lug—and ,thirdly, be able to release the shell through its base section to the rammer. One way to manufacture a downwards opening shell carrier having the basic shape of a horizontal semi-cylindrical chute is based on the use of two quarter-cylindrical shaped carrier plates that in initial position meet with a longitudinal joint along the centre of the chute thus formed, and which plates can be displaced or pivoted away from each other with the axis of the cylinder as pivot axis until they meet each other along their other longitudinal edges at the diametrically opposite side of the axis of the cylinder whereby the base of the chute is completely open. This type of motion can be achieved, for example, if each of the quarter-cylindrical shaped carrier plates is mounted on at least two semi-circular carrier yokes that are displaceable along similar semi-circular guides fixed above the outfeed direction of the chute. Displacement of the semi-circular carrier yokes along the guides can be by means of a cog driven by an electric motor and operating directly on the gear teeth in the semi-circular carrier yokes.

If in the method indicated above these semi-circular carrier yokes are displaced along the guides to the open position of the device the quarter-cylindrical shaped carrier plates meet in the upper position of the cylindrical space, while in closed position they meet under the centre of the guide chute that they form.

Figure 2:
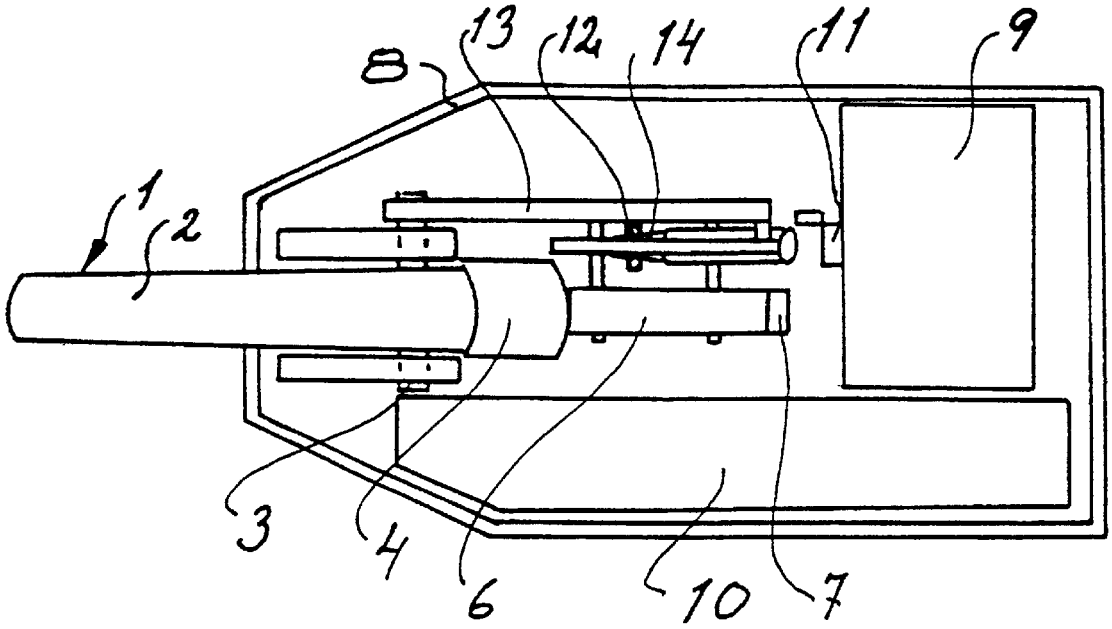
Figure 7:
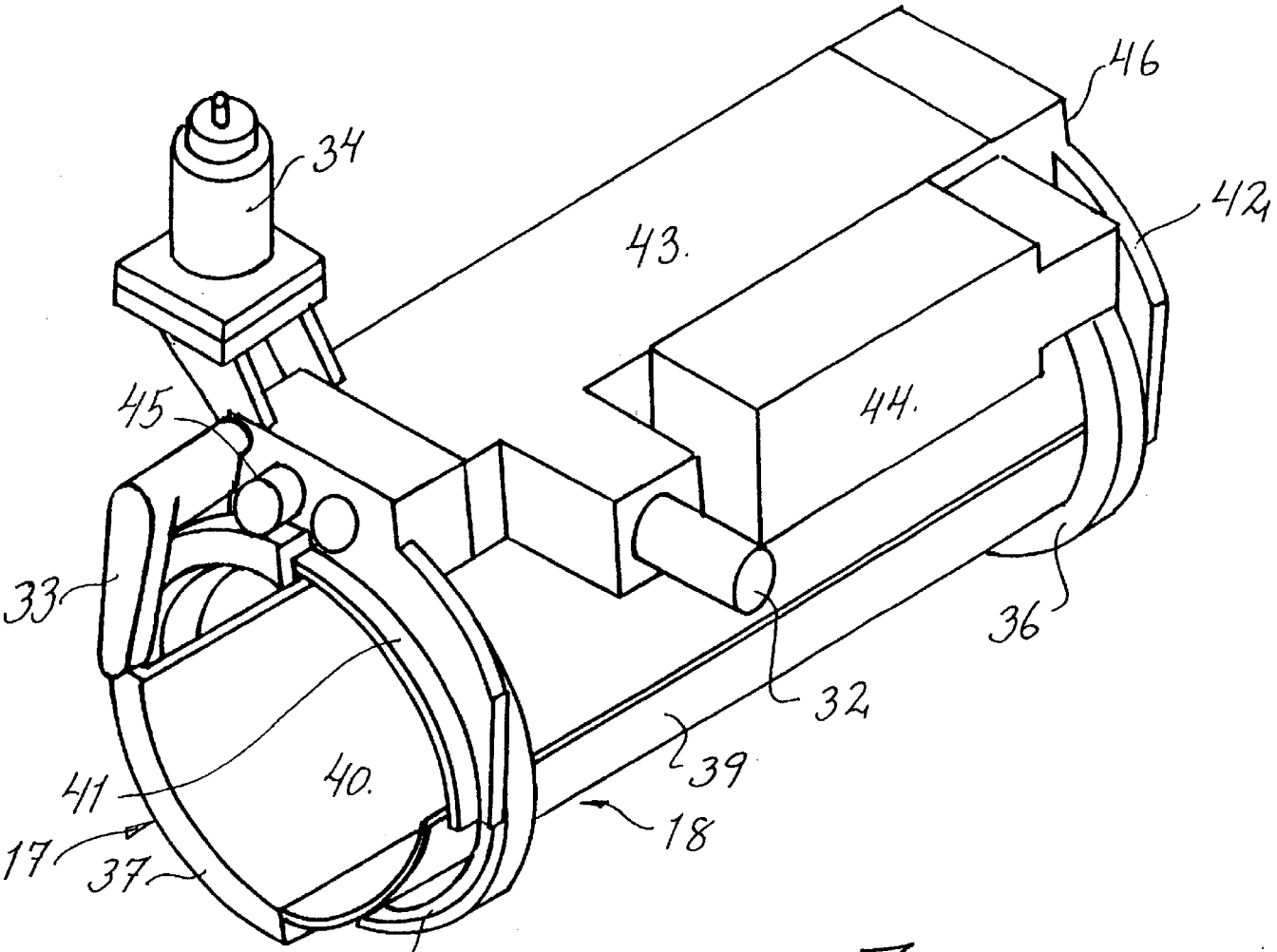
Figure 8:
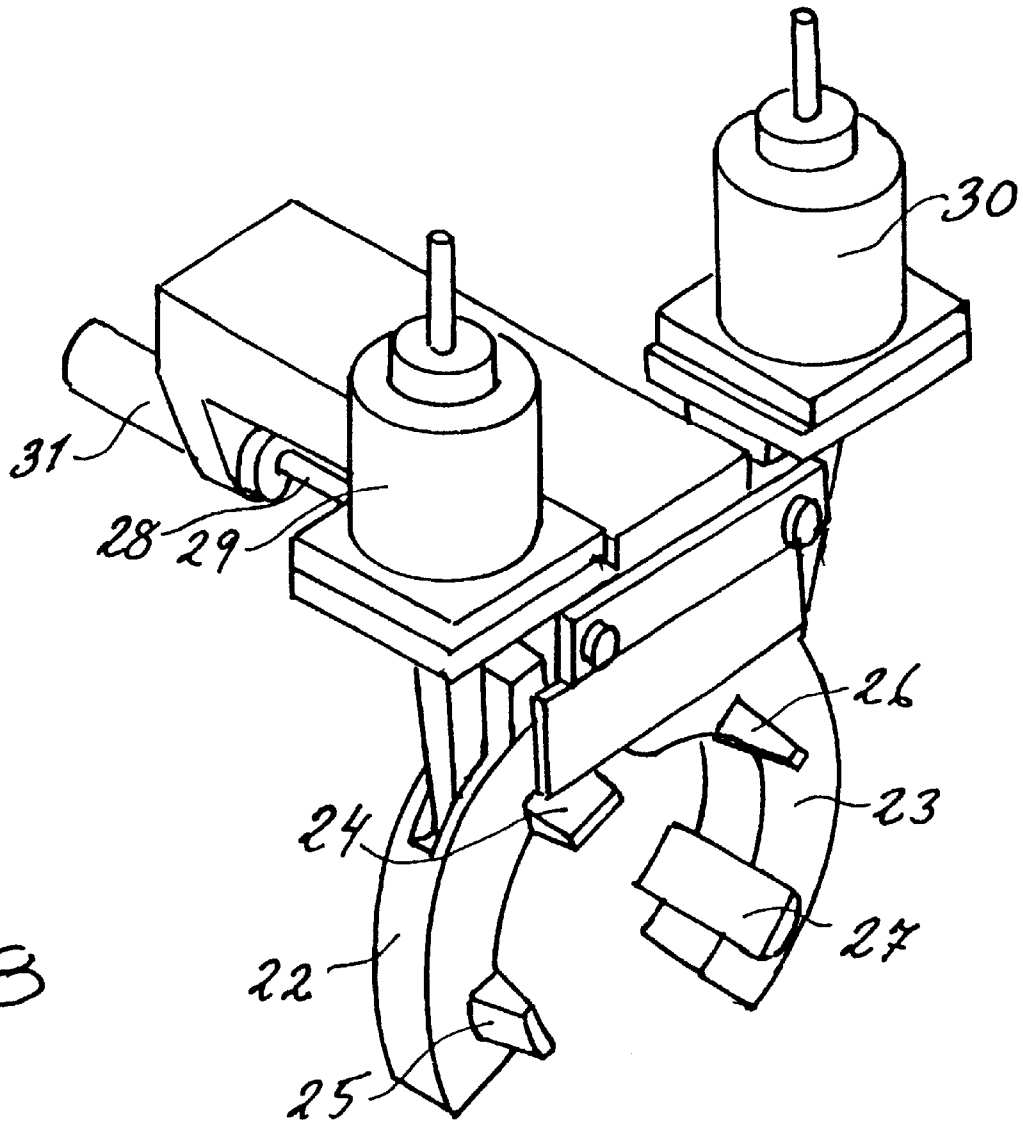

The present invention is defined in the subsequent Patent Claims and shall now be described in further detail with reference to the appended figures in which FIG. 1 shows a longitudinal section through the traverse system of the gun in question, FIG. 2 shows a section of the same system viewed from above, FIGS. 3–6 show views to a larger scale of parts of FIG. 1 illustrating the various sequence stages when loading the gun in question, FIG. 7 shows a diagonal section of the shell carrier to a larger scale, and FIG. 8 shows a diagonal section of the brake module to a larger scale.

Parts shown on more than one figure have the same designation irrespective of scale and projection.

The gun 1 in the various figures has a barrel 2, a trunnion centre 3 around which the barrel can be pivoted for elevation, and a basically drawn breech ring 4 incorporating the breech opening for loading and the breech mechanism. The elevating mass incorporates guide beams 5 on which is mounted a laterally displaceable loading cradle 6. The latter is equipped with a flick rammer 7. The gun 1 is mounted in a battlefield fragment-proof turret. The turret also incorporates a fixed shell magazine 9 as well as a propellant charge magazine with ancillary equipment that is not directly illustrated but is assumed to be located in compartment 10.

The shell magazine 9 has a shell outfeed aperture 11 through which freely selectable shells can be fed out at a velocity of several metres per second.

Other main components illustrated in FIGS. 1 and 2 are the brake module 12 that is assumed to be securely mounted relative to the turret 8, and the loading pendulum 13.

The latter is equipped with a shell carrier that is described later. Shells are generally designated 14.

The following description refers primarily to FIGS. 3–6 on which only the parts directly concerned are illustrated.

Figure 3:
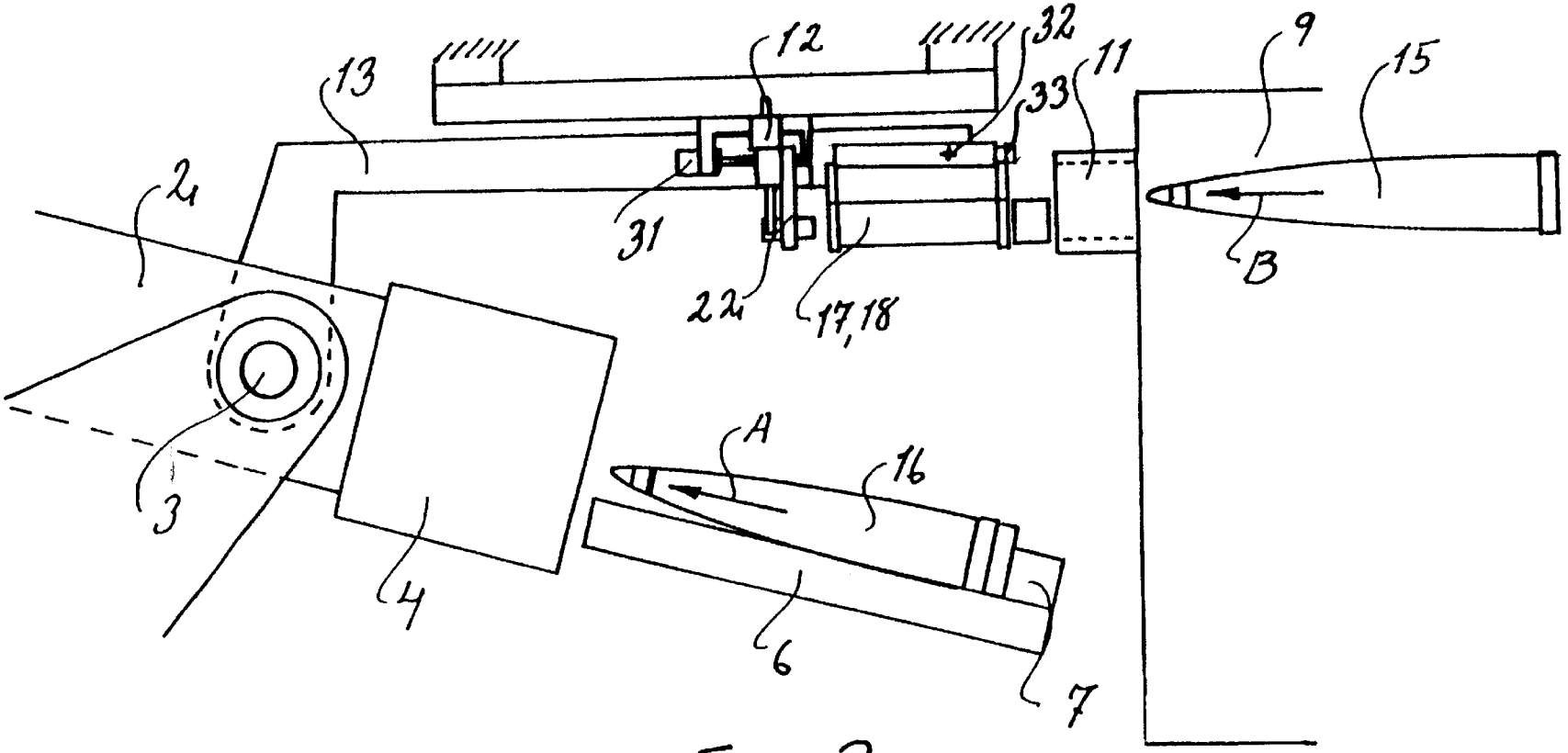

On FIG. 3 a shell 15 is fed out from the magazine 9 indicated on the figure. Another shell 16 is on the loading cradle ready for ramming. Shell 16 is rammed by the flick rammer 7 in the direction indicated by arrow A. Shell 15 is fed forwards in the direction indicated by arrow B, and the pointed nose section thus passes through the shell carrier devices 17 and 18 of the loading pendulum 13. The shell carrier, which is described in more detail in conjunction with FIG. 7, is openable downwards and is fitted with a rear deployable stop lug 33 that is used to give the shells a pre-defined rear stop position.

The nose section of shell 15 illustrated on FIG. 3 passes at high velocity through the shell carrier devices 17 and 18 until it reaches a grab comprising two brake jaws 22 and 23 (see FIG. 8), each of which is fitted with two brake blocks 24, 25 and 26, 27. The brake jaws 22 and 23 are in turn pivot mounted and operated by electromagnets 29 and 30. Brake jaws 22 and 23 are thus openable. In closed position they engage with the shell 15 at a point along its tapered nose section. The brake jaws 22 and 23 are mounted via shaft 28 on an outfeed brake device 31 operating linearly in the outfeed direction of the shell 15 that rapidly stops the linear motion of the shell 15 and, as soon as it has stopped, reverses it until its rear plane rests against the stop lug 33 deployed in the meantime.

Figure 4:
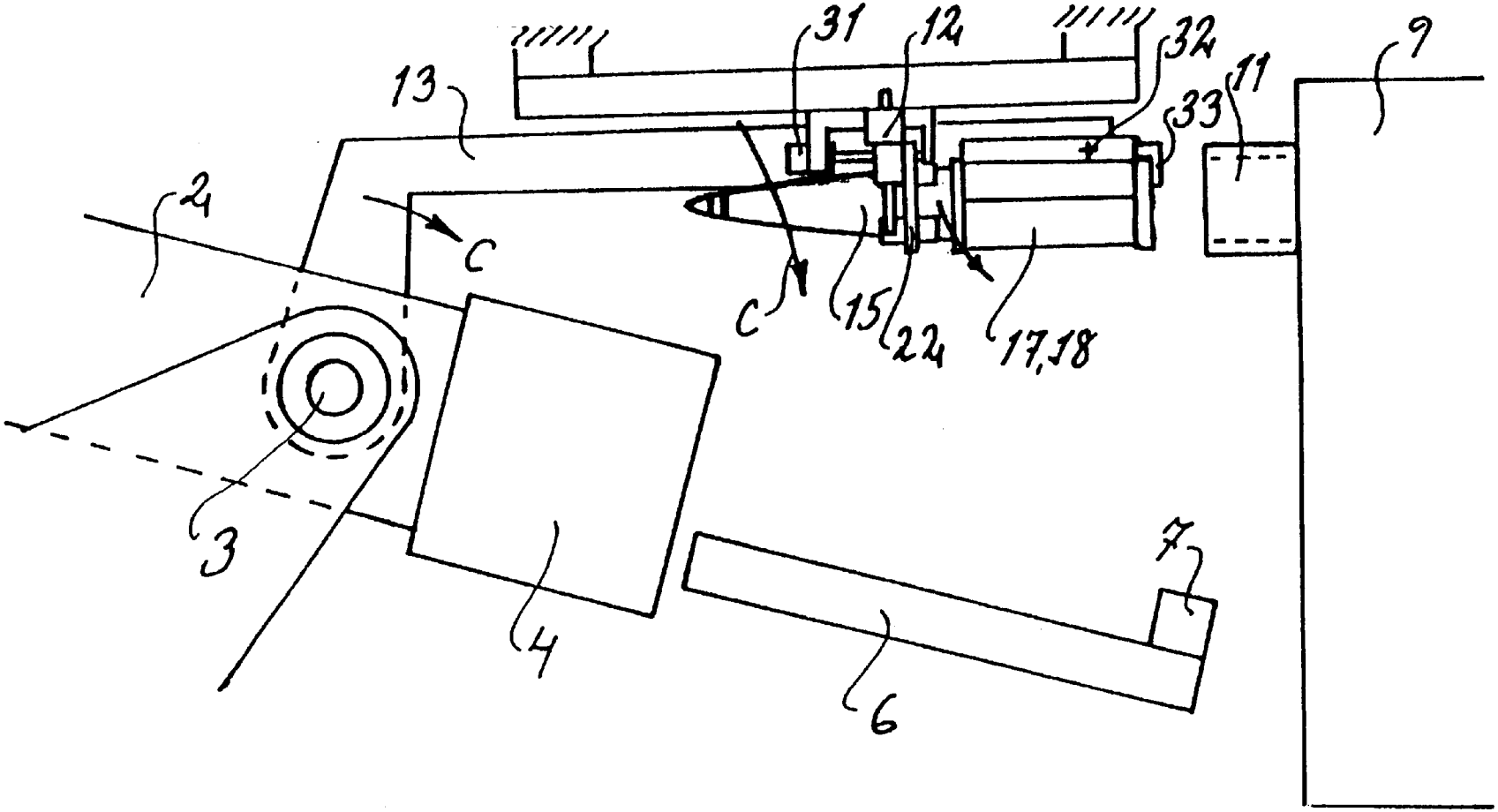
Figure 5:
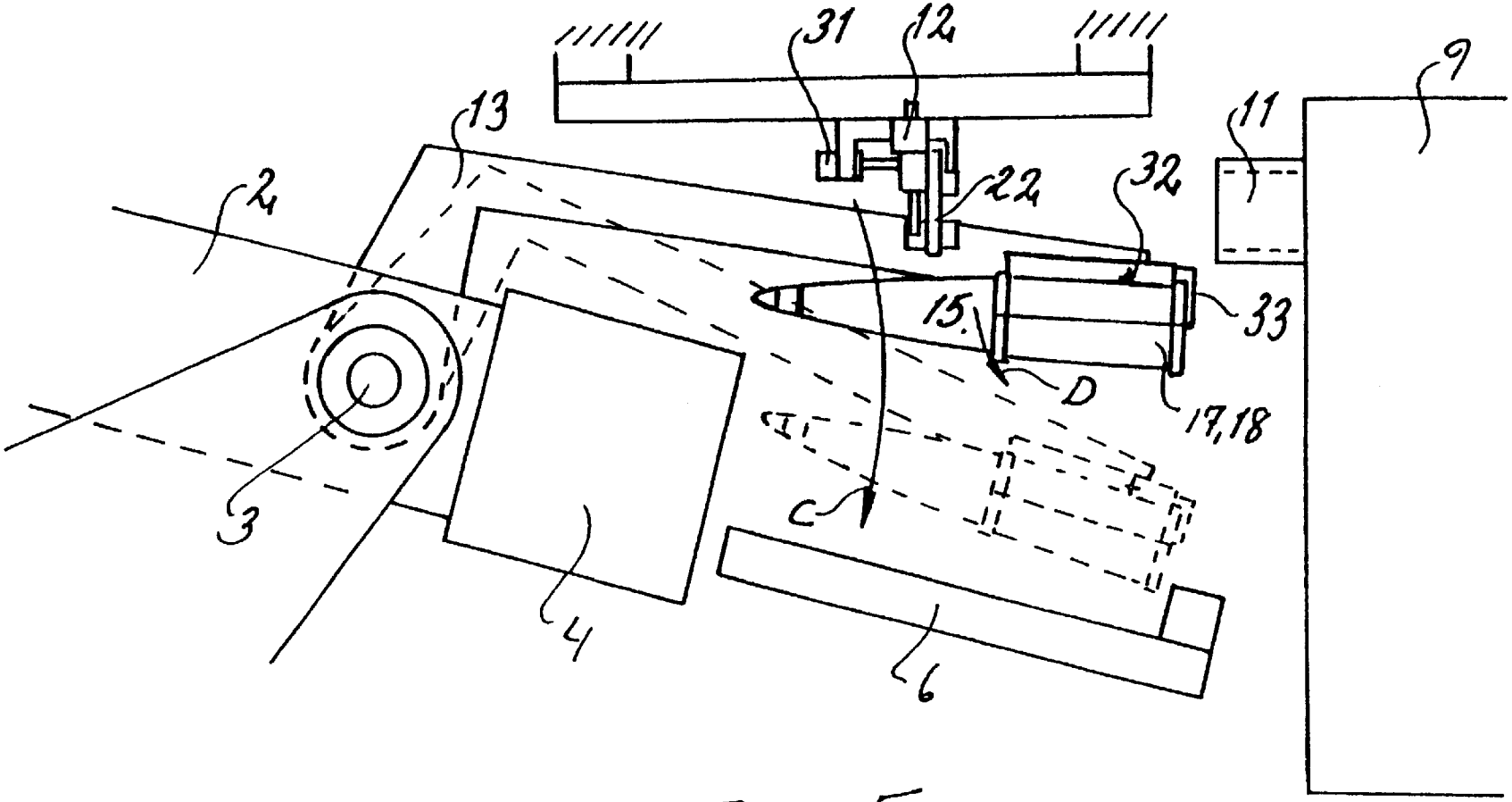
Figure 6:
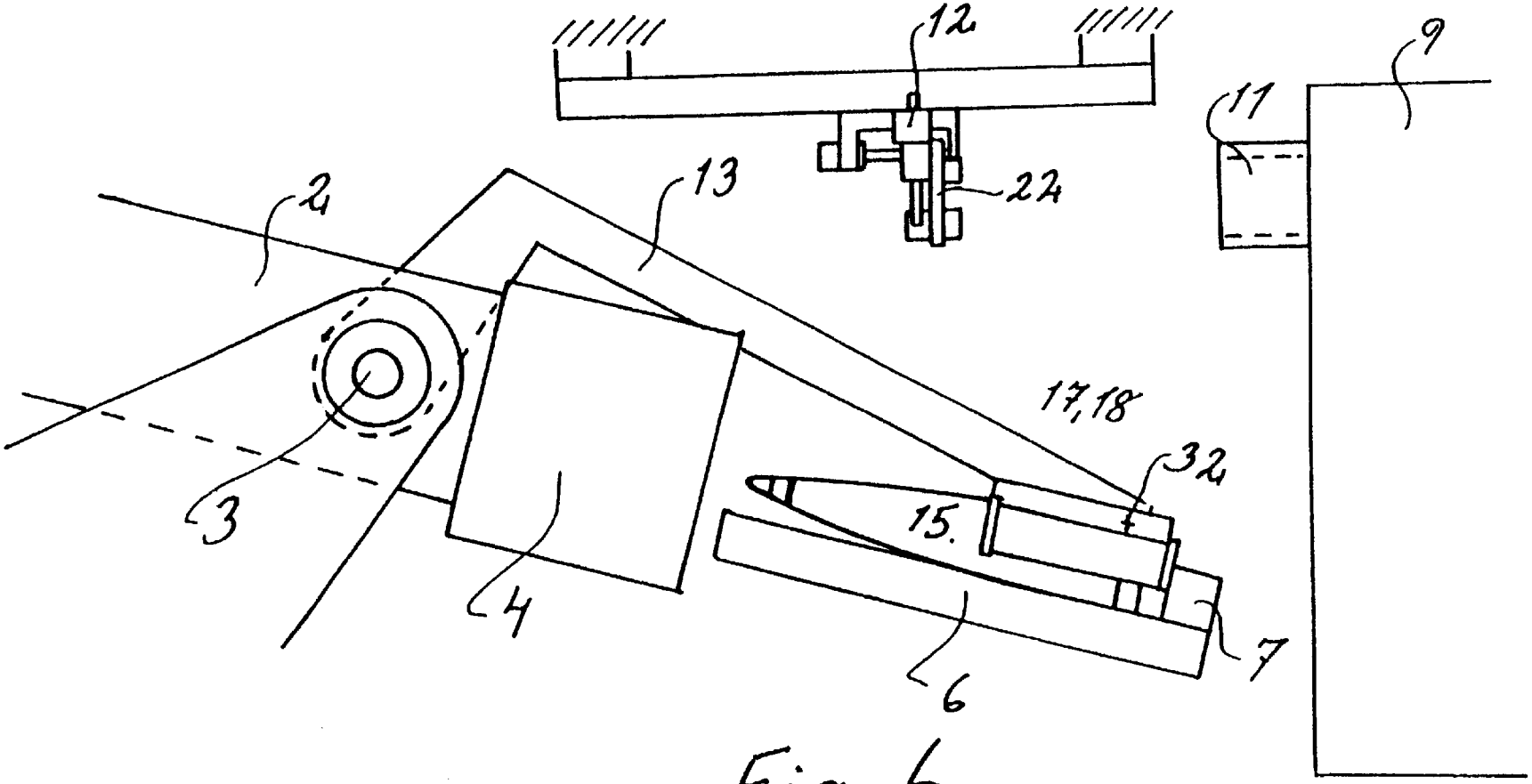

As soon as shell 15 has stopped and assumed its pre-defined position against stop lug 33 the status is as illustrated in FIG. 4. Simultaneously the brake jaws 22 and 23 open and the loading pendulum 13 starts to swing down around the trunnion centre 3 in the direction indicated by arrow C. The shell carrier devices 17 and 18 are pivot mounted on a pivot shaft 32 mounted at the other end of the loading pendulum 13. The pivoting of shell 15 around pivot shaft 32 is controlled by a control arc mounted on the gun and a linkage system that are not illustrated herein. The angle between the loading pendulum 13 and the shell carrier is thus dependent on the angle of the loading pendulum 13 relative to the gun. During the re-angling of the shell 15 to the angle of elevation of the gun the shell carrier always has a slight rearwards tilt so that the shell remains pressed against stop lug 33. This eliminates the need for a special retention device to hold the shell in place in the shell carrier. The drive motor for the loading pendulum has not been illustrated in the figures so as not to obscure more pertinent features. It could, for example, comprise an electric motor located beside the loading pendulum and driving the latter via a chain system. By changing the angle of the shell 15 around both its axes (i.e. the gun's trunnion centre 3 and the shell carrier pivot shaft 32) the angle of the shell shown in FIG. 5 can gradually be changed relative to its outfeed direction until its angular position is the same as the angle of elevation of the gun which coincides with the angle of the shell loading cradle 6. The latter can be displaced laterally relative to the barrel 2 so as not to obstruct barrel recoil. The loading pendulum 13 and the shell loading cradle 6 can thus be aligned with each other when the shell is to be transferred between them.

As soon as the shell loading cradle 6 has received a new shell and the barrel is not in process of recoil nor is about to recoil, the shell loading cradle is displaced laterally to the position shown in FIG. 2, i.e. in direct alignment with the breech ring/opening 4.

Moreover, it should be noted that the shell loading pendulum 13 is parallel to and beside the brake module 12 while the shell carrier devices 17 and 18 via their pivot shaft 32 are parallel to and, at the instant of shell outfeed from the magazine, in line with the brake jaws 22 and 23 that receive the shell.

As the shell carrier 17, 18 is tilted slightly rearwards throughout the re-angling of the shell, i.e. until the shell reaches the loading cradle 6, no special gripping appliance is required for the shell which simply rests against the stop lug 33 during the entire re-angling sequence as previously indicated.

The shell carrier illustrated in FIG. 7 shows the pivot shaft 32 by means of which the carrier is pivot mounted on loading pendulum 13, and the rear stop lug 33 including the latter's control device in the form of a solenoid valve 34. The two halves of the actual shell carrier 17 and 18 each consist of two semi-circular carrier yokes 35–38 of which 35, 36 and 37 are visible in the figure. Each pair of these semi-circular carrier yokes, one pair at each end, are attached at each end to two quarter-cylindrical shaped carrier plates 39 and 40. The semi-circular carrier yokes are displaceably mounted on two semi-circular support sections 41 and 42 which are in turn mounted at each end of the shell carrier mainpiece 43 which is an integral part of the shell carrier. Both the quarter-cylindrical shaped carrier plates 39 and 40 are initially in their lower position resting against each other along two adjoining longitudinal edges forming a guide and carrier chute for the shells. On the shell carrier mainpiece 43 there is also an electric motor 44 which, via gear wheel units 45 and 46 arranged on a level with the semi-circular carrier yokes 35–38, can displace the semi-circular carrier yokes 35–38 along the semi-circular support sections 41 and 42 until the opposite longitudinal edges of the quarter-cylindrical shaped carrier plates 39 and 40 meet immediately below the shell carrier mainpiece 43. In this position the lower half of the cylindrical space formed by the shell carrier when closed becomes fully opened. It is thus this open position that the shell carrier 17, 18 assumes when it is to transfer a shell to the loading cradle 6.

The next function stage is to remove the shell carrier 17, 18 from the loading cradle 6, to laterally displace the latter to its final position in alignment with the barrel 2, and to activate the flick rammer 7 to ram the shell into the breech. After the round has been fired the complete finction sequence can be activated for the next round.

I claim:

1. A method for handling artillery shells in artillery guns that have an integral shell magazine fixed in the traverse system but independent from an elevating mass which on command outfeeds shells through a shell magazine outfeed aperture one by one with a specific linear velocity along a longitudinal axis of each shell and where each shell after outfeed is transferred laterally in relation to its own longitudinal axis to a gun loading position immediately outside the breech ring partly by a loading pendulum designed to pivot around a trunnion centre of the gun and whose task is to overcome the difference in angle between the shell magazine outfeed axis and the angle of elevation of the gun and partly by a shell loading cradle whose task is to overcome the lateral distance between the location of the shell magazine outfeed aperture and the breech ring wherein the linear outfeed motion of each shell after it has completely left the magazine is braked to zero through a limited linear distance in a dedicated brake module mechanically independent from the loading pendulum and from which module the loading pendulum takes over the shell as soon as the shell has reached a pre-defined stop position for its rear plane.

2. A method as claimed in claim 1 wherein each shell when fed out from the shell magazine is fed through a shell carrier interconnected with the loading pendulum and operating initially as a guide chute until after the linear motion of the shell has been braked to zero when the shell in the same shell carrier is transferred to a position directly above the shell loading cradle for a subsequent lateral displacement to the designated loading position immediately behind the breech ring of the gun.

3. A device as claimed in the method in claim 1 for handling artillery shells in artillery guns that have an integral shell magazine fixed in the traverse system but independent from the elevating mass of a type which on command outfeeds shells one by one with a specific linear velocity in the longitudinal axis of each shell and where each shell after outfeed shall be re-angled to coincide with the angle of elevation of the gun and shall be transferred laterally in relation to its longitudinal axis to the loading position immediately outside the breech ring partly by a loading pendulum designed to pivot around the trunnion centre of the gun and whose task is to overcome the difference in angle between the shell magazine outfeed axis and the angle of elevation of the gun and partly by a shell loading cradle whose task is to overcome the lateral distance between the location of the shell magazine outfeed aperture and the breech ring wherein the device comprises both the loading pendulum, pivotable around the trunnion centre of the gun and equipped with a shell carrier and the brake module that is mechanically independent of the loading pendulum and is initially aligned with the loading pendulum shell carrier which module operates in initial mode via brake jaws arranged initially in line with the loading pendulum shell carrier.

4. A device as claimed in claim 3 wherein its loading pendulum is configured with a pendulum arm that at one end has a first pivot shaft around which it is manoeverable to various angles around the trunnion center of the gun and at the other end a second pivot shaft parallel with the first around which the loading pendulum shell carrier is maneuverable to various angles relative to the loading pendulum and whereby the setting of the angle positions at each of these pivot shafts is controlled separately.

5. A device as claimed in claim 3 wherein the brake jaws of the brake module are arranged so that they grip each shell fed out ahead of the shell carrier in the outfeed direction.

6. A device as claimed in claim 5 wherein the brake module brake jaws and the shell carrier devices of the loading pendulum are aligned so that when a shell is fed out from the shell magazine the shell carrier devices form a passage for the nose section of each shell fed out extending to the brake module brake jaws and whereby the shell carrier devices of the loading pendulum are openable.

7. A device as claimed in claim 6 wherein the brake module is designed so that after it has braked the linear outfeed motion of the shell to zero it reverses the shell until its rear plane rests against a permanently pre-defined stop position.

8. A device as claimed in claim 6 wherein the shell carrier devices of the loading pendulum constitute a semi-cylindrical space adapted to the shell calibre in question which space is defined by two quarter-cylindrical shaped carrier plates facing each other with their lower-most longitudinal edges meeting in a common bottom joint while in shell carrier mode thus forming a guide chute dedicated to each shell and which quarter-cylindrical shaped carrier plates are so designed that they can be pivoted around an axis coinciding with the longitudinal axis of the shell carrier so that they then meet along their opposite longitudinal edges in a longitudinal joint extending along the upper side of the shell carrier whereby the lower half of the cylindrical space is left completely open.

9. A device as claimed in claim 6 wherein each quarter-cylindrical shaped carrier plate comprises at least two semi-circular carrier yokes and, when the shell carrier is in closed mode, downwards facing quarter-cylindrical shaped carrier plates which, as the semi-circular carrier yokes can be displaced along the upwards facing semi-circular carrier sections, can be moved together above the cylindrical space thereby leaving the lower half open.

10. A device as claimed in the method in claim 2 for handling artillery shells in artillery guns that have an integral shell magazine fixed in the traverse system but independent from the elevating mass of a type which on command outfeeds shells one by one with a specific linear velocity in the longitudinal axis of each shell and where each shell after outfeed shall be re-angled to coincide with the angle of elevation of the gun and shall be transferred laterally in relation to its longitudinal axis to the loading position immediately outside the breech ring partly by a loading pendulum designed to pivot around the trunnion centre of the gun and whose task is to overcome the difference in angle between the shell magazine outfeed axis and the angle of elevation of the gun and partly by a shell loading cradle whose task is to overcome the lateral distance between the location of the shell magazine outfeed aperture and the breech ring wherein the device comprises both the loading pendulum, pivotable around the trunnion centre of the gun and equipped with a shell carrier and the brake module that is mechanically independent of the loading pendulum and is initially aligned with the loading pendulum shell carrier which module operates in initial mode via brake jaws arranged initially in line with the loading pendulum shell carrier.

11. A device as claimed in claim 4 wherein the brake jaws of the brake module are arranged so that they grip each shell fed out ahead of the shell carrier in the outfeed direction.

12. A device as claimed in claim 7 wherein the shell carrier devices of the loading pendulum constitute a semi-cylindrical space adapted to the shell calibre in question which space is defined by two quarter-cylindrical shaped carrier plates facing each other with their lower-most longitudinal edges meeting in a common bottom joint while in shell carrier mode thus forming a guide chute dedicated to each shell and which quarter-cylindrical shaped carrier plates are so designed that they can be pivoted around an axis coinciding with the longitudinal axis of the shell carrier so that they then meet along their opposite longitudinal edges in a longitudinal joint extending along the upper side of the shell carrier whereby the lower half of the cylindrical space is left completely open.

13. A device as claimed in claim 7 wherein each quarter-cylindrical shaped carrier plate comprises at least two semi-circular carrier yokes and, when the shell carrier is in closed mode, downwards facing quarter-cylindrical shaped carrier plates which, as the semi-circular carrier yokes can be displaced along the upwards facing semi-circular carrier sections, can be moved together above the cylindrical space thereby leaving the lower half open.

14. A device as claimed in claim 8 wherein each quarter-cylindrical shaped carrier plate comprises at least two semi-circular carrier yokes and, when the shell carrier is in closed mode, downwards facing quarter-cylindrical shaped carrier plates which, as the semi-circular carrier yokes can be displaced along the upwards facing semi-circular carrier sections, can be moved together above the cylindrical space thereby leaving the lower half open.

15. A method as claimed in claim 1 wherein the shells are released in a downward motion from the dedicated brake module.

16. A method as claimed in claim 1 wherein each shell is also translated vertically during transfer to the loading position.

17. A method for handling artillery shells in artillery guns, the method comprising:

providing a shell magazine in a traverse system;

providing a loading pendulum that pivots about a trunnion center;

outfeeding shells through a shell magazine outfeed aperture, wherein the shells have a linear velocity along a longitudinal axis of each shell as they are outfed from the aperture;

braking the linear velocity of each shell through a linear distance in a brake module; and transferring each shell to a gun loading position outside a breech ring of a barrel, partly by the loading pendulum that pivots around a trunnion centre of the gun, wherein the loading pendulum pivots the shells to reduce a difference in angle between a shell magazine outfeed axis and an angle of elevation of the gun, and partly by a shell loading cradle that translates the shells toward the gun loading position, and wherein the loading pendulum pivots away from the brake module as it pivots the shells.

18. A method as claimed in claim 17 comprising:

releasing the shells in a downward motion from the brake module.

19. A method as claimed in claim 18 wherein outfeeding comprises:

feeding shells through a shell carrier connected with the loading pendulum, wherein the shell carrier guides the shells until the linear motion of the shell has been braked to zero, and wherein the shell carrier pivots with the loading pendulum.

20. A method as claimed in claim 18 wherein braking the linear velocity of each shell comprises:

operating the brake module in an initial mode wherein brake jaws of the brake module are initially aligned with the loading pendulum shell carrier.

21. A device as claimed in claim 20 braking the linear velocity of each shell comprises:

gripping the shells in the brake jaws of the brake module so that the brake jaws grip each shell.

22. A method as claimed in claim 21 wherein the brake module brakes each shell's motion to zero velocity.

* * * * *